US008224221B2

(12) United States Patent
Matsuki et al.

(10) Patent No.: US 8,224,221 B2
(45) Date of Patent: Jul. 17, 2012

(54) ENDLESS BELT INCLUDING A METAL LAYER HAVING LOW RESIDUAL STRAIN, FIXING DEVICE AND IMAGE FORMING APPARATUS

(75) Inventors: Keiko Matsuki, Minamiashigara (JP); Hiroshi Tamemasa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 407 days.

(21) Appl. No.: 12/555,590

(22) Filed: Sep. 8, 2009

(65) Prior Publication Data

US 2010/0196065 A1 Aug. 5, 2010

(30) Foreign Application Priority Data

Feb. 3, 2009 (JP) ..... 2009-022988

(51) Int. Cl.
*G03G 15/20* (2006.01)

(52) U.S. Cl. ..... 399/329

(58) Field of Classification Search ..... 399/329; 219/216

See application file for complete search history.

(56) References Cited

U.S. PATENT DOCUMENTS

| | | | | |
|---|---|---|---|---|
| 7,215,916 | B2 * | 5/2007 | Kishino et al. | 399/329 |
| 2001/0007846 | A1 | 7/2001 | Sakuma et al. | |
| 2002/0104351 | A1 | 8/2002 | Sakuma et al. | |
| 2002/0146259 | A1 | 10/2002 | Zhou et al. | |

FOREIGN PATENT DOCUMENTS

| | | |
|---|---|---|
| JP | A-7-13448 | 1/1995 |
| JP | A-2001-225134 | 8/2001 |
| JP | A-2002-258648 | 9/2002 |
| JP | A-2004-126274 | 4/2004 |
| JP | A-2005-241891 | 9/2005 |

* cited by examiner

*Primary Examiner* — David Gray
*Assistant Examiner* — G. M. Hyder
(74) *Attorney, Agent, or Firm* — Oliff & Berridge, PLC

(57) ABSTRACT

The endless belt is provided with: a metal layer that includes at least one layer, that is cylindrically formed, and that has not more than 10 degrees as a half width of a diffraction peak in X-ray diffraction; and a release layer that is stacked on the metal layer.

18 Claims, 4 Drawing Sheets

ENDLESS BELT INCLUDING A METAL LAYER HAVING LOW RESIDUAL STRAIN, FIXING DEVICE AND IMAGE FORMING APPARATUS

CROSS REFERENCE TO RELATED APPLICATIONS

This application is based on and claims priority under 35 USC §119 from Japanese Patent Application No. 2009-022988 filed Feb. 3, 2009.

BACKGROUND

1. Technical Field

The present invention relates to an endless belt, a fixing device and an image forming apparatus.

2. Related Art

In recent years, there is proposed an electrophotographic image forming apparatus in which a metallic belt excellent in strength is used as a fixing belt to meet a demand for speeding-up of a fixing device with a heating method.

SUMMARY

According to an aspect of the present invention, there is provided an endless belt including: a metal layer that includes at least one layer, that is cylindrically formed, and that has not more than 10 degrees as a half width of a diffraction peak in X-ray diffraction; and a release layer that is stacked on the metal layer.

BRIEF DESCRIPTION OF THE DRAWINGS

Exemplary embodiment(s) of the present invention will be described in detail based on the following figures, wherein.

DETAILED DESCRIPTION

Hereinafter, a description will be given of an exemplary embodiment of this invention. It is to be noted that the present invention is not limited to this exemplary embodiment to be given below and may be implemented with various modifications within its scope. In addition, the drawings to be used are for illustrating this exemplary embodiment, and do not show actual dimensions.

(Image Forming Apparatus)

Figure 1:
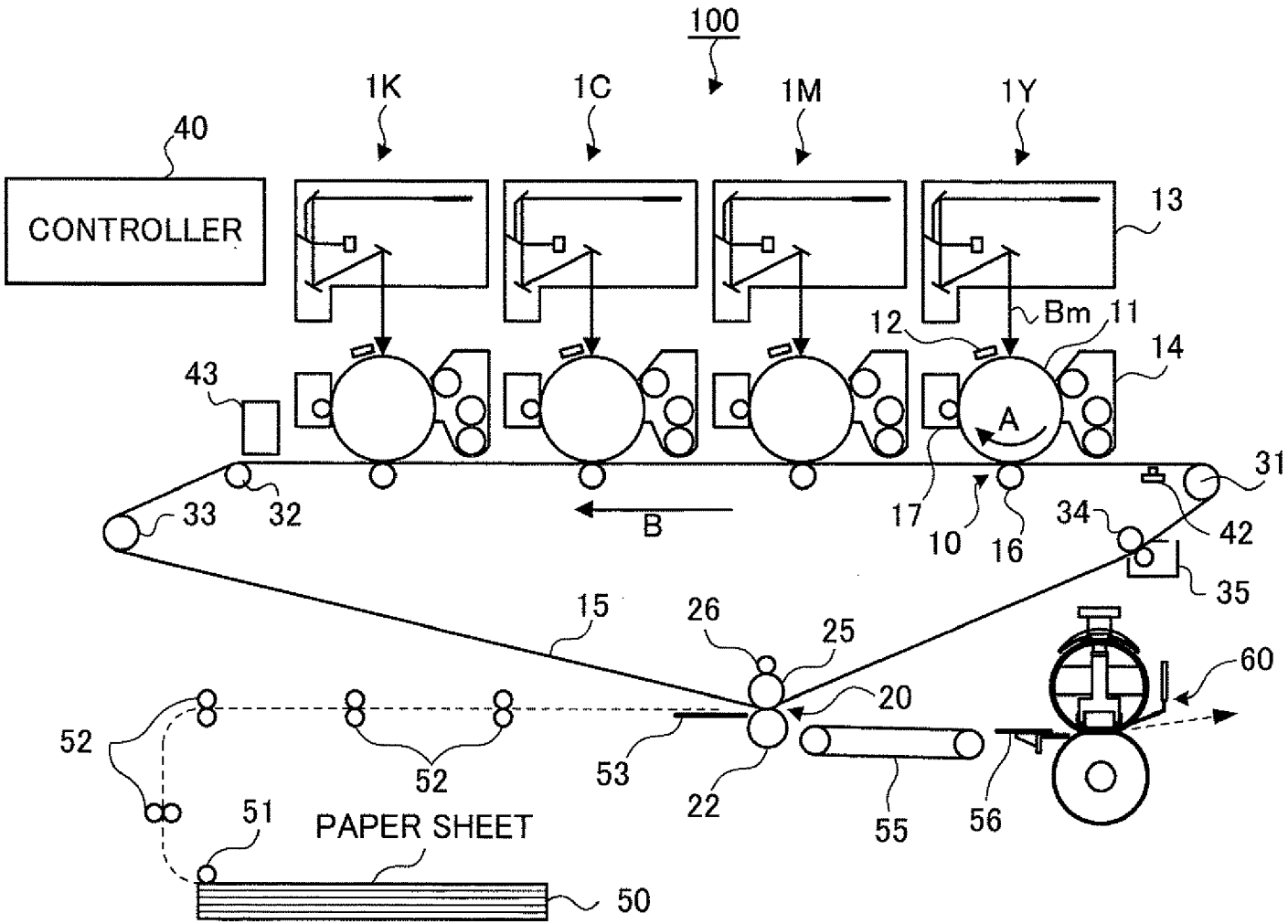
FIG. 1 is a schematic configuration diagram of an image forming apparatus to which the exemplary embodiment is applied.

FIG. 1 is a schematic configuration diagram of an image forming apparatus to which the exemplary embodiment is applied. Here, descriptions will be given by taking an image forming apparatus employing an intermediate transfer type, generally called a tandem-type image forming apparatus, as an example. An image forming apparatus 100 shown in FIG. 1 includes, as image formation units, multiple image forming units 1Y, 1M, 1C and 1K each of which forms a toner image of a corresponding color component by electrophotography. Moreover, the image forming apparatus 100 includes, as a transfer unit: primary transfer units 10 that sequentially transfer (primarily transfer) the toner images of the respective color components formed by the image forming units 1Y, 1M, 1C and 1K, onto an intermediate transfer belt (image holder) 15; and a secondary transfer unit 20 that collectively transfers (secondarily transfers) overlapped toner images, transferred onto the intermediate transfer belt 15, onto a sheet serving as a recording medium. Moreover, the image forming apparatus 100 includes, as a fixing unit, a fixing device 60 that fixes the secondarily transferred image on the sheet. The image forming apparatus 100 also includes a controller 40 that controls operation of each device (unit).

As shown in FIG. 1, each of the image forming units 1Y, 1M, 1C and 1K includes a photoconductive drum 11, a charging device 12, a laser-exposure device 13, a developing device 14, a primary transfer roll 16 and a drum cleaner 17. The photoconductive drum 11 rotates in an arrow A direction. The charging device 12 charges the photoconductive drum 11. The laser-exposure device 13 writes an electrostatic latent image on the photoconductive drum 11. The developing device 14 stores a toner of the corresponding color component and forms, with the toner, a visible image of the electrostatic latent image written on the photoconductive drum 11. The primary transfer roll 16 transfers, in the primary transfer unit 10, the toner image of the color component, formed on the photoconductive drum 11, onto the intermediate transfer belt 15. The drum cleaner 17 removes the toner remaining on the photoconductive drum 11. These image forming units 1Y, 1M, 1C and 1K are disposed in an approximately straight line in the order of yellow (Y), magenta (M), cyan (C) and black (K) from an upstream side of the intermediate transfer belt 15.

The intermediate transfer belt 15 is rotationally driven by various rolls in an arrow B direction shown in FIG. 1. As the various rolls, included are: a driving roll 31 that drives the intermediate transfer belt 15; a supporting roll 32 that supports the intermediate transfer belt 15, a tension roll 33 that applies certain tension to the intermediate transfer belt 15 to prevent meandering of the intermediate transfer belt 15; a backup roll 25 that is provided in the secondary transfer unit 20; and a cleaning backup roll 34 that is provided in a cleaning unit that wipes off remaining toners on the intermediate transfer belt 15.

Each primary transfer unit 10 includes the primary transfer roll 16 that faces the corresponding photoconductive drum 11 with the intermediate transfer belt 15 interposed therebetween. The secondary transfer unit 20 includes: a secondary transfer roll (transfer member) 22 that is disposed on a toner image holding surface side of the intermediate transfer belt 15; the backup roll 25 that is disposed on a back surface side of the intermediate transfer belt 15, and serves as a counter electrode to the secondary transfer roll 22; and a power feeding roll 26 that applies secondary transfer bias to the backup roll 25.

Downstream of the secondary transfer unit 20, an intermediate transfer belt cleaner 35 is disposed, which removes remaining toners and paper dust on the intermediate transfer belt 15. Upstream of the yellow image forming unit 1Y, a reference sensor (home position sensor) 42 is disposed that generates a reference signal for coordinating timings of image formations by the image forming units 1Y, 1M, 1C and 1K. In addition, downstream of the black image forming unit 1K, an image density sensor 43 that adjusts image quality is disposed.

A sheet transportation system of the image forming apparatus 100 includes: a sheet supplying unit 50; a pickup roll 51 that picks up a sheet in the sheet supplying unit 50 and then transports the sheet; transporting rolls 52 that transport the sheet; a transporting chute 53 that sends the sheet to the secondary transfer unit 20; a transporting belt 55 that transports the sheet after secondary transfer by the secondary transfer roll 22 to the fixing device 60; and a fixing entrance guide 56 that guides the sheet to the fixing device 60.

A description will be given of a basic image forming process of the image forming apparatus 100.

In the image forming apparatus 100 shown in FIG. 1, after image data outputted from an image capturing apparatus (IIT) (not shown in the figure) or the like is subjected to image processing, the image data is converted into four color tone data of Y, M, C and K, and then resultant data is outputted to the laser exposure device 13. The laser exposure device 13 irradiates the respective photoconductive drums 11 rotating in the arrow A direction in the image forming units 1Y, 1M, 1C and 1K, with exposure beams Bm outputted from a semiconductor laser in accordance with the inputted color tone data, for example. Each of the surfaces of the photoconductive drums 11 is charged by the corresponding charging device 12, and then each of the surfaces is scanned and exposed by the laser exposure device 13. Thereby, electrostatic latent images are formed. The formed electrostatic latent images are developed as Y, M, C, and K toner images by respective image forming units 1Y, 1M, 1C and 1K.

Next, the toner images formed on the respective photoconductive drums 11 are sequentially overlapped with each other on the surface of the intermediate transfer belt 15 at the primary transfer units 10, so that primary transfer is performed. The intermediate transfer belt 15 moves in the arrow B direction, and transports the toner images to the secondary transfer unit 20. The sheet transportation system supplies a sheet from the sheet supplying unit 50 in synchronization with timing when the toner images are transported to the secondary transfer unit 20.

In the secondary transfer unit 20, unfixed toner images held on the intermediate transfer belt 15 are electrostatically transferred onto a sheet interposed between the intermediate transfer belt 15 and the secondary transfer roll 22. Thereafter, the sheet on which the toner images are electrostatically transferred is transported to the fixing device 60 by the transporting belt 55, and the fixing device 60 processes the unfixed toner images on the sheet with heat and pressure so that the unfixed toner images are fixed on the sheet. The sheet on which the fixing image is formed is transported to an outputted sheet placement portion provided at an output portion of the image forming apparatus 100.

(Fixing Device 60)

Next, a description will be given of the fixing device 60 in the present exemplary embodiment.

Figure 2:
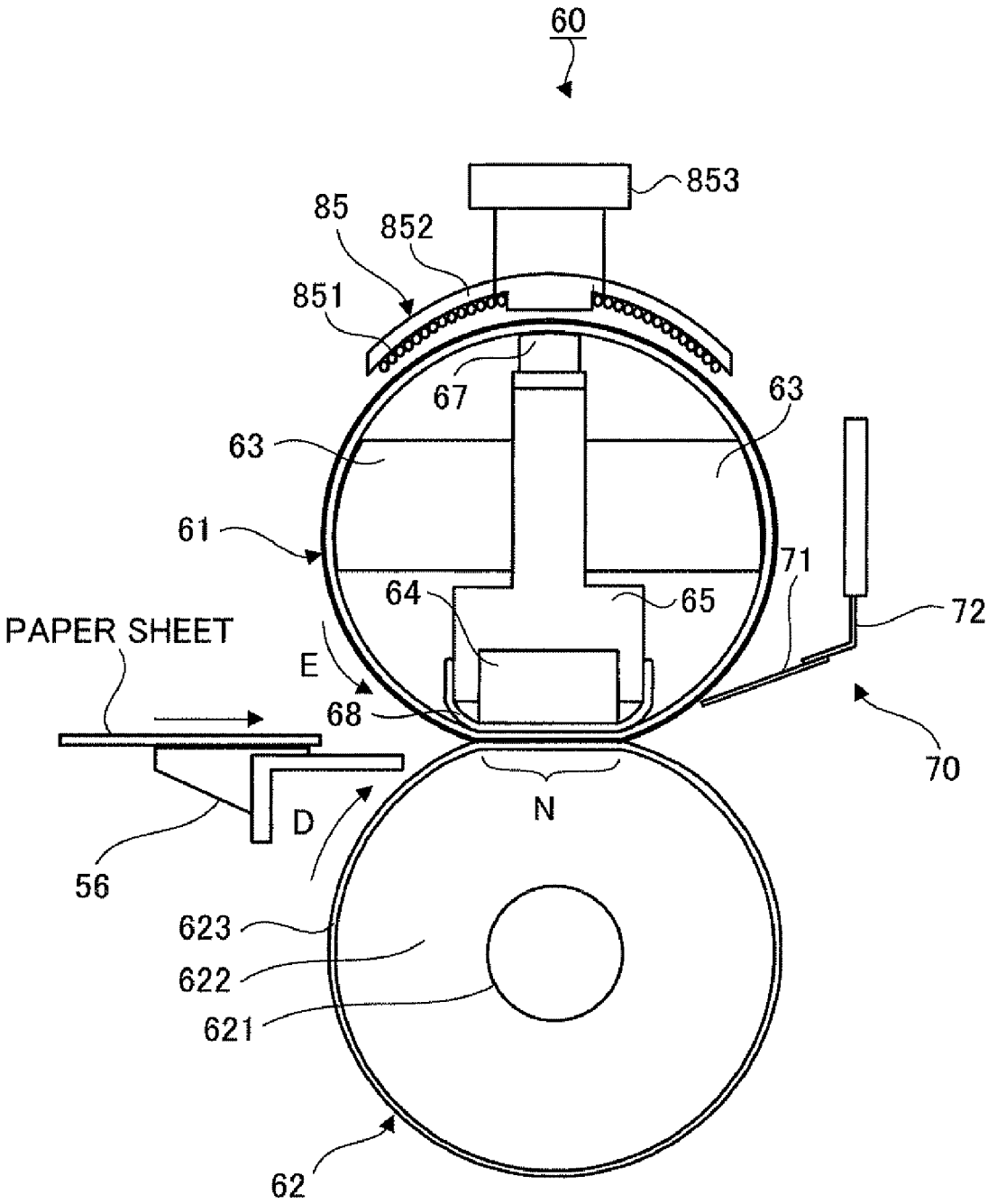
FIG. 2 is a view showing a configuration of the fixing device.

FIG. 2 is a view showing a configuration of the fixing device 60. In the present exemplary embodiment, a description will be given of the fixing device 60 employing an electromagnetic induction heating type, as an example.

As shown in FIG. 2, the fixing device 60 includes: a fixing belt 61 as an endless belt; a magnetic field generation unit 85 as an example of an electromagnetic induction heating member that causes the fixing belt 61 to generate heat by use of a magnetic field caused by an alternating current; a pressure roll 62 arranged so as to face the fixing belt 61; and a pressure pad 64 which is pressed by the pressure roll 62 through the fixing belt 61.

The fixing belt 61, which is an endless belt, has a metal layer including at least one layer. The metal layer has a half width of a diffraction peak in X-ray diffraction, which is 10 degrees or lower. In addition, the fixing belt 61 is formed into a cylinder having a diameter of approximately 30 mm, for example. A layer configuration of the fixing belt 61 will be described later. The fixing belt 61 is supported by the pressure pad 64, a belt guide member 63, and edge guide members (not shown in the figure) disposed at both side end parts of the fixing belt 61 so as to be freely driven to rotate. The fixing belt 61 is in pressure contact with the pressure roll 62 at a nip portion N, and is driven to rotate in an arrow E direction in accordance with the pressure roll 62.

The belt guide member 63 is attached to a holder 65 disposed inside the fixing belt 61. The belt guide member 63 is formed as multiple ribs (not shown in the figure) directed to a rotation drive direction of the fixing belt 61, and thus a contact area between the belt guide member 63 and the inner circumferential surface of the fixing belt 61 is made to be small. The belt guide member 63 is made of a heat resistant resin such as PFA, PPS or the like, which has a low friction coefficient and a low rate of heat transfer. By this configuration, sliding resistance of the belt guide member 63 to the inner circumferential surface of the fixing belt 61 is reduced, and heat radiation is lowered.

The pressure pad 64 is pressed by the pressure roll 62 through the fixing belt 61 so as to form the nip portion N. The pressure pad 64 is supported by the holder 65 so as to press the pressure roll 62 at, for example, a load of 35 kgf, with a spring or an elastic body. The pressure pad 64 is formed of an elastic body made of silicone rubber, fluoro rubber or the like, and is planarly formed on the pressure roll 62 side, and generates an approximately uniform nip pressure at the nip portion N. When the fixing belt 61 is separated from the surface of the pressure pad 64 on the pressure roll 62 side, sharp curvature change occurs. Thus, a sheet after the fixing is peeled from the fixing belt 61.

In a peel aid member 70 provided around a downstream side of the nip portion N, a peel baffle 71 is caused to be directed to a direction opposed to a rotation direction of the fixing belt 61 (a counter direction), and the peel baffle 71 is held by a baffle holder 72. In addition, a low friction sheet 68 is provided between the pressure pad 64 and the fixing belt 61, and the sliding resistance between the pressure pad 64 and the inner circumferential surface of the fixing belt 61 is reduced. In the present exemplary embodiment, the low friction sheet 68 is configured so as to be independent of the pressure pad 64, and the end parts thereof are fixed to the holder 65.

To the holder 65, a lubricant application member 67 is provided entirely in a longitudinal direction of the fixing device 60. The lubricant application member 67 is in contact with the inner circumferential surface of the fixing belt 61, and supplies lubricant to a sliding portion between the fixing belt 61 and the low friction sheet 68. It is to be noted that, examples of the lubricant are liquid oil such as a silicone oil, a fluorine-containing oil or the like; grease in which a solid material and a liquid are mixed; and a combination thereof.

The pressure roll 62 includes: a solid core (cylindrical cored bar) 621 made of iron, which has a diameter of 16 mm; a rubber layer 622 that covers the outer circumferential surface of the core 621 and that is made of, for example, silicone sponge having a thickness of 12 mm; and a surface layer 623 formed by a heat resistant resin coating using a material such as PFA, or a heat resistant rubber coating, which has a thickness of 30 μm, for example. Note that, a manufacturing method of the pressure roll 62 includes a method in which a solid shaft and a fluoro resin tube formed by a polyfluoroalkyl vinyl ether (PFA) tube having the inner circumferential surface with an adhesive primer applied thereto are set in a mold, a liquid foamed silicone rubber is injected between the fluoro resin tube and the solid shaft, and then silicone rubber is vulcanized and foamed by heat treatment (150 degrees C.×2 hrs) so as to form an elastic layer, for example.

The pressure roll 62 is disposed so as to face the fixing belt 61, and rotates in an arrow D direction at a process speed of 140 mm/s for example, and causes the fixing belt 61 to be moved. In addition, the nip portion N is formed by keeping a state where the fixing belt 61 is held by the pressure roll 62 and the pressure pad 64 while interposed therebetween. A sheet on which unfixed toner images are held is caused to pass through this nip portion N, and the unfixed toner images are fixed onto the sheet by application of heat and pressure.

The magnetic field generation unit 85 as an example of an electromagnetic induction heating member has a cross section of a rounded shape along a shape of the fixing belt 61, and is installed at an interval of approximately 0.5 mm to 2 mm from the outer circumferential surface of the fixing belt 61. The magnetic field generation unit 85 includes an exciting coil 851 that generates a magnetic field, a coil supporting member 852 that holds the exciting coil 851, and an exciting circuit 853 that supplies an electric current to the exciting coil 851.

The exciting coil 851 used here is formed by a litz wire wound so as to be formed into a closed-loop shape such as an oval, an ellipse, and a rectangle. Here, the litz wire is made by binding approximately 16 to 20 copper wires which each have a diameter (of 0.5 mm and which are insulated with each other. An alternating current having a frequency set in advance is applied to the exciting coil 851 by the exciting circuit 853, whereby an alternating magnetic field H is generated around the exciting coil 851. When the alternating magnetic field H goes across the metal layer of the later-described fixing belt 61, an eddy current I is generated in such a manner that a magnetic field preventing the alternating magnetic field H from changing is generated by an electromagnetic induction effect. The frequency of the alternating current applied to the exciting coil 851 is set at, for example, 10 kHz to 50 kHz. The eddy current I flows into a metal layer 61*a* (refer to FIG. 3) of the fixing belt 61, whereby Joule heat is generated due to an electricity W ($W=I^2R$) that is in proportion to a resistant value R of the metal layer 61*a*, which heats the fixing belt 61.

The coil supporting member 852 is composed of a non-magnetic material having heat resistance. Such a non-magnetic material includes heat resistant resin such as a heat-resistant glass, polycarbonate, polyethersulfone, PPS (polyphenylene sulfide) or the like, and a heat resistant resin in which glass fiber is mixed therewith, for example.

Note that, in the present exemplary embodiment, a description has been given of the fixing device 60, which employs an electromagnetic induction heating type, including the electromagnetic induction heating member as a heating member that heats the fixing belt 61. However, as the heating member, a radiating lamp heater or a resistant heater may also be employed.

An example of the radiating lamp heater is a halogen lamp. Examples of the resistant heater are an iron-chrome-aluminum base, a nickel-chrome base, platinum, molybdenum, tantalum, tungsten, silicon carbide, molybdenum-silicide, carbon and the like.

In the fixing device 60, along with the rotation of the pressure roll 62 in the arrow D direction, the fixing belt 61 is driven to be rotated in the arrow E direction, and the fixing belt 61 is exposed to a magnetic field generated by the exciting coil 851. At this time, an eddy current is generated in the metal layer of the fixing belt 61 in the vicinity of the pressing portion with the pressure roll 62, and the outer circumferential surface of the fixing belt 61 is sufficiently heated up to fixable temperature. The fixing belt 61 thus heated moves to the pressing portion with the pressure roll 62. A sheet whose surface is provided with unfixed toner images is transported by a transporting unit. When the sheet passes through the pressing portion between the fixing belt 61 and the pressure roll 62, the unfixed toner image is heated by the fixing belt 61 so as to be fixed onto the surface of the sheet. Thereafter, the sheet whose surface includes the image thus formed is transported by the transporting unit, and is outputted from the fixing device 60. On the other hand, the fixing belt 61, which has finished the fixing processing at the pressing portion, and accordingly in which surface temperature of the outer circumferential surface is decreased, rotates in a direction toward the exciting coil 851 in order to be heated again for preparing the next fixing processing.

(Fixing Belt 61)

Next, a description will be given of the fixing belt 61 to which the present exemplary embodiment is applied.

Figure 3:
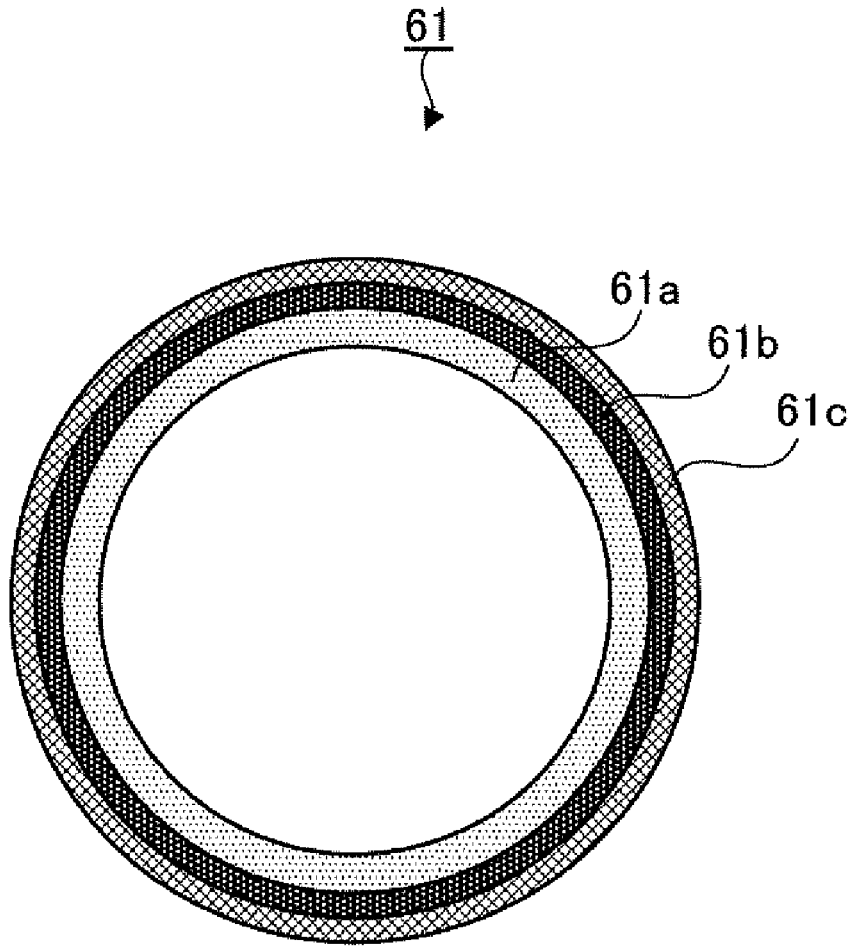
FIG. 3 is a schematic cross-sectional view showing an example of a configuration of the fixing belt (endless belt) to which the exemplary embodiment is applied.

FIG. 3 is a schematic cross-sectional view showing an example of a configuration of the fixing belt (endless belt) 61 to which the exemplary embodiment is applied. As shown in FIG. 3, the fixing belt 61 has a three-layer configuration in which the metal layer 61*a* as a base, an elastic layer 61*b*, and a release layer 61*c* in this order from the inner circumferential side.

The metal layer as the base is formed by, for example, an electroforming method in the case of using a metal, such as nickel, to which the electroforming technique is applicable, or a deformation processing method in the case of using a stainless alloy, nickel alloy or the like, which will be described later.

However, the metal layer has accumulation of residual strain at the forming processing, in general. Moreover, in the case where the metallic belt is used as a fixing belt for example, strain is accumulated due to cyclic deformation given at the fixing in addition to the residual strain at the forming processing. Therefore, fatigue breaking is likely to occur.

To avoid this, the metal layer 61*a* as a base in the present exemplary embodiment is configured by a metal layer including at least one layer. The metal layer has a half width of the diffraction peak in the X-ray diffraction, which is 10 degrees or lower. Here, in the present exemplary embodiment, the half width of the diffraction peak in the X-ray diffraction is an index representing a scale for crystal growth of the metallic material forming the metal layer 61*a*. It is considered that, as the half width is more decreased, the residual strain of the metal layer 61*a* is more reduced.

If the half width of the diffraction peak in the X-ray diffraction is excessively large, the residual strain of the metal layer 61*a* is increased, and thus the fixing belt 61 tends to become brittle.

Here, examples of a metallic material forming the metal layer 61*a* are stainless alloy, nickel, nickel alloy, titanium, titanium alloy, tantalum, molybdenum, hastelloy, permalloy, maraging, steel, aluminum, aluminum alloy, copper, copper alloy, pure iron, iron and steel, and the like. Among these, stainless alloy, nickel, or nickel alloy may be particularly used.

For the metal layer 61*a*, adopted is a multi-layer structure in which one or more types of the above-described metallic materials are combined. As a preparation method for the metal layer 61*a*, a conventionally known deformation processing method is exemplified. Specifically, a deep drawing method, a spinning method, a pressing method, a rotary forming method and the like are exemplified. In the present exemplary embodiment, the metal layer 61*a* is prepared by such a processing method, so that the film thickness thereof is within a range of about 5 μm to about 100 μm and particularly within a range of about 30 to about 60 μm.

Here, a description will be given of a preparation method for the metal layer having a multi-layer structure in which three metal layers are stacked as the metal layer 61*a*.

Figure 4:
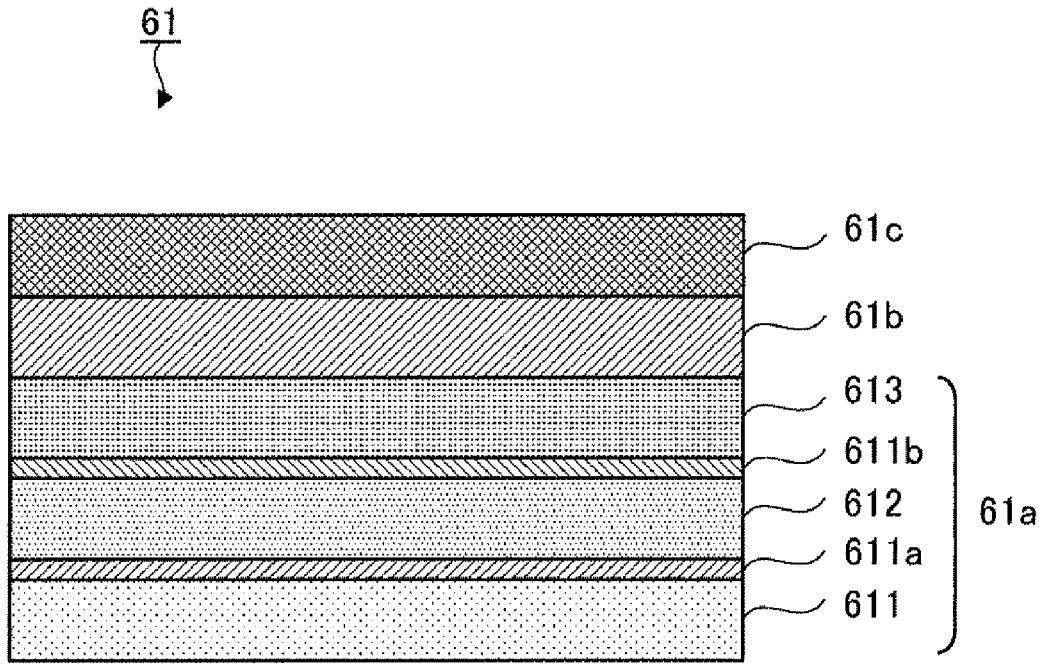
FIG. 4 is a view for explaining a structure of the fixing belt having the metal layer with the multi-layer structure.

FIG. 4 is a view for explaining a structure of the fixing belt 61 having the metal layer 61*a* with the multi-layer structure.

The metal layer 61*a* having the multi-layer structure, which is included in the fixing belt 61, is prepared as follows. Metallic plates necessary for the three metal layers, which are a base metal layer 611, a heat generation metal layer 612, and an intermediate metal layer 613, are prepared, oxide films are removed from adhesive surfaces of the respective plates by polishing, and then rolling processing is performed in a cold state, and further cold welding is performed. By this operation, a laminated body is prepared.

Next, to this laminated body, joint layers 611*a* and 611*b* are formed by performing first heat treatment (first heat treatment step). By this heat treatment, the metallic plates are strongly adhered to each other, so that a laminated plate, which has a multi-layer structure, with a necessary thickness is prepared.

Subsequently, deformation processing of the laminated plate which has a jointed multi-layer structure is performed, whereby the metal layer with the multi-layer structure, which is formed as an endless belt, is obtained (processing step) Here, the deformation processing is performed by a deep drawing method, a spinning method, a pressing method, a rotary forming method or the like.

Finally, on the metal layer with the multi-layer structure thus prepared, the elastic layer 61*b* and the release layer 61*c* are formed (surface-layer formation step), whereby the fixing belt 61 is obtained. Here, in the multi-layer structure, the three metal layers are stacked.

In the present exemplary embodiment, a stainless plate (a thickness of 0.4 mm) is used as the base metal layer, and a copper plate (a thickness of 0.1 mm) is used as the heat generation metal layer. Then, the metal layer 61*a* is prepared by the following operation.

First, adhesive surfaces of plate members which are the stainless plate and the copper plate are polished, and the oxide films thereof are removed. Subsequently, the rolling processing is performed in a cold state, and the metallic plates are adhered to each other, whereby a two-layer laminated plate with the thickness of 0.5 mm is prepared. Further, the two-layer laminated plate is subjected to heat treatment under a condition that treatment temperature is 900 degrees C. and treatment time is 60 minutes, in a nitrogen atmosphere. Next, the two-layer laminated plate is formed as a cylindrical container through a press and deep drawing, and then a metallic endless belt with a two-layer lamination is manufactured through the rotary forming method (an inner diameter of 30 mm, a length of 370 mm, and a wall thickness of 55 μm).

In the present exemplary embodiment, a reason for using, as the metal layer 61*a* of the fixing belt 61, metallic materials subjected to the deformation processing as described above is as follows. Specifically, for example, an endless belt formed by an electrolytic plating method is bent and rotated with a large curvature, whereby the endless belt is strained due to the bending deformation. Further, when the metal layer formed by the electrolytic plating method is repeatedly strained by a circular rotation driving of the endless belt, the endless belt may not function as the fixing belt since the metal layer is fatigued and cracked because of alignment of the metallic crystals in the thickness direction. Such a crack occurs depending on the formation of the metal layer of the belt by the electrolytic plating method. In the present exemplary embodiment, the metal layer 61*a* of the fixing belt 61 is formed by the deformation processing (rolling) method, whereby the metallic crystals are aligned in the surface direction, and occurrence of a crack due to the repeat bending deformation is reduced.

In a state where the cylindrical metal layer 61*a* which is prepared through the deformation processing is cut open in an axial direction, a surface strain of the metal layer 61*a* may be about −10% to about +30%. In particular, the surface strain may be about −5% to about +10%. Here, the cylindrical metal layer 61*a* is a component of the fixing belt 61 to which the present exemplary embodiment is applied.

Here, the surface strain in the present exemplary embodiment is defined as a measured value of a strain gauge (for example, KFEL-2-120-C1L1M2R manufactured by KYOWA ELECTRONIC INSTRUMENTS CO., LTD.) adhered to the surface of the cylindrical metal layer 61*a*. Specifically, the measured value of the strain gauge is obtained after the cylindrical metal layer 61*a* is cut open, in the axial direction, at a portion 180 degree opposite to a portion where the strain gauge is adhered, and after force is released.

If the surface strain of the metal layer 61*a* is excessively small (minus (−) side), the fixing belt 61 tends to be deformed due to a residual compression stress. If the surface strain of the metal layer 61*a* is excessively large (plus (+) side), the fixing belt 61 tends to be broken due to a residual pulling stress.

Moreover, in the state where the cylindrical metal layer 61*a* prepared through the deformation processing is cut open in the axial direction as described above, the distance between end faces of the metal layer 61*a* that has been cut open may be about 10 mm to about +30 mm. In particular, the distance between the end faces of the metal layer 61*a* that has been cut open may be about −5 mm to about +10 mm. Here, the cylindrical metal layer 61*a* is a component of the fixing belt 61 to which the present exemplary embodiment is applied.

If the distance between the end faces of the metal layer 61*a* that has been cut open is excessively small, the fixing belt 61 tends to be deformed due to the residual compression stress. If the distance between the end faces of the metal layer 61*a* that has been cut open is excessively large, the fixing belt 61 tends to be broken due to the residual pulling stress.

The elastic layer 61*b* is formed by using a known heat resistant rubber such as silicone rubber or fluoro rubber, for example. Among these, silicone rubber may be particularly used because of small surface tension and excellent elasticity. Such silicone rubber includes RTV silicone rubber, and HTV silicone rubber, for example. Specifically, polydimethyl silicone rubber (MQ), methyl vinyl silicone rubber (VMQ), methyl phenyl silicone rubber (PMQ), fluorosilicone rubber (FVMQ) and the like are exemplified. A thickness of the elastic layer 61*b* is generally 0.1 mm to 0.5 mm. In particular, the thickness thereof may be 0.15 mm to 0.3 mm. The rubber hardness of the elastic layer 61*b* (JIS-A hardness) is normally 5 degrees to 50 degrees. In particular, the rubber hardness thereof may be 10 degrees to 30 degrees.

A formation method of the elastic layer 61*b* includes a ring coating method, an immersion coating method, an injection molding method, and the like.

The release layer 61*c* is formed by using a material having appropriate releasability from a toner image. Examples of such a material are: fluoro resin such as fluoro rubber, polytetrafluoroethylene (PTFE), perfluoroalkylvinylether copolymer (PFA), tetrafluoroethylene hexafluoropropylene copolymer (FEP) and the like; silicone resin; and polyimide resin. A thickness of the release layer 61*c* is generally 10 μm to 50 μm. In particular, the thickness thereof may be 20 μm to 40 μm.

Examples of a forming method of the release layer 61*c* are an electrostatic powder coating method, a spray coating method, an immersion coating method and a centrifugal film forming method and the like.

EXAMPLES

Hereinafter, the present invention will be more specifically described on the basis of examples and comparative examples. It is to be noted that, the present invention is not limited to the examples described below without departing from the scope of the invention.

Examples 1 to 12

Preparation of Fixing Belts

A clad sheet (a thickness of 0.4 mm) having each of metal layer configurations shown in Table 1 is subjected to heat treatment at 1,100 degrees C. in a nitrogen atmosphere. Next, the clad sheet is formed as a cylindrical container through a press and deep drawing, and then a metallic clad seamless belt (base metal layer=heat generation layer) is obtained by a rotary forming method. Here, the metallic clad seamless belt has properties shown in Table 1 and has an inner diameter of 30 mm, a length of 370 mm and a radial thickness of 50 μm.

Next, liquid silicone rubber (KE194035, a product of liquid silicone rubber 35° manufactured by Shin-Etsu Chemical Co., Ltd.), which is prepared so as to have hardness of 35° is applied to the surface of the heat generation layer so that the film thickness thereof is 200 μm. Here, the hardness conforms to JIS type A. Then, the surface is dried, and a liquid silicone rubber layer (elastic layer) in a dry state is obtained.

Subsequently, PFA dispersion (500CL manufactured by DU PONT-MITSUI FLUOROCHEMICALS COMPANY, LTD.) is applied to the surface of the above liquid silicone rubber layer in the dry state so that a film thickness thereof is 30 μm, and the layer is burned at 380 degrees C., and thus the elastic layer made of silicone rubber and the release layer made of PFA are formed. By this operation, the fixing belt is obtained.

(Preparation of Pressure Roll)

A metallic hollow core bar and a fluoro resin tube are set in a mold. Here, the fluoro resin tube has an outer diameter of 50 mm, a length of 340 mm and a thickness of 30 μm, and an adhesion primer is applied to the inner surface of the tube. Thereafter, liquid foamed silicone rubber (a layer thickness: 2 mm) is injected between the fluoro resin tube and the core bar, and then the silicone rubber is vulcanized through a heating treatment (150 degrees C., 2 hours). By this operation, a pressure roll having foamed rubber elasticity is prepared.

(Durability Evaluation for Heat Generation Caused by Electromagnetic Induction at Idle Rotation)

Each of the fixing belts and each of the pressure rolls, which are prepared as described above, are attached to an image forming apparatus (Docu Print C620 manufactured by Fuji Xerox Co., Ltd.) having the fixing device 60 shown in FIG. 2. Thereafter, by using this image forming apparatus, the durability evaluation for heat generation caused by electromagnetic induction at idle rotation, for which the fixing belt is idled for 200 hours in a row in a state of heating the fixing belt with electromagnetic induction, is performed. In the durability evaluation, heat generation maintaining property of the fixing belt (a crack of the heat generation layer) is evaluated. The result is shown in Table 1.

Comparative Examples 1 to 8

Base metal layers (=heat generation layers), which respectively have metal layer configurations and metal layer thicknesses shown in columns for the comparative examples 1 to 8 in Table 1 and have property values shown in Table 1, are prepared. Further, the elastic layer made of silicone rubber and the release layer made of perfluoroalkyl vinyl ether (PFA) are formed on each of the base metal layers by the similar operation to the examples, so that the fixing belts are obtained.

Each of the fixing belts prepared as described above is attached to the image forming apparatus (Docu Print C620 manufactured by Fuji Xerox Co., Ltd.) having the fixing device 60 shown in FIG. 2, similarly to the examples. Thereafter, by using this image forming apparatus, the durability evaluation for heat generation caused by electromagnetic induction at idle rotation, for which the fixing belt is idled for 200 hours in a row in the state of heating the fixing belt with electromagnetic induction, is performed. In the durability evaluation, heat generation maintaining property of the fixing belt (a crack of the heat generation layer) is evaluated. The result is shown in Table 1.

Comparative Examples 9 and 10

Each of the fixing belts is prepared as described below.

A cylindrical stainless mold having an outer diameter of 30 mm is immersed in an electrolytic plating bath (pH=3.0, temperature in the bath=50 degrees C.) including nickel sulfate as a main component, and electrodeposition is performed for 60 minutes with cathode current density=7 A/dm$^2$. By this operation, a metallic belt made of nickel, which has an inner diameter of 30 mm, a film thickness of 50 μm and a length of 370 mm, is prepared. This metallic belt made of nickel is immersed in an electrolytic plating bath (pH=2.0, temperature in the bath=30 degrees C.) including copper sulfate as a main component, and electrodeposition is performed for 60 minutes with cathode current density=5 A/dm$^2$. Thereby, a metallic belt, which is made of nickel with copper plating, is prepared. Here, copper is plated on the surface of the metallic belt made of nickel, and the prepared metallic belt has an inner diameter of 30 mm, a film thickness of 10 μm, and a length of 370 mm. Further, similarly to the above-described preparation of the fixing belts, the elastic layer and the release layer are formed. By this operation, the metallic belt for each of the comparative examples is prepared, and is used as the fixing belt.

Each of the fixing belts prepared as described above is attached to the image forming apparatus (Docu Print C620 manufactured by Fuji Xerox Co., Ltd.) having the fixing device 60 shown in FIG. 2, similarly to the examples. Thereafter, by using this image forming apparatus, the durability evaluation for heat generation caused by electromagnetic induction at idle rotation, for which the fixing belt is idled for 200 hours in a row in the state of heating the fixing belt with electromagnetic induction, is performed. In the durability evaluation, heat generation maintaining property of the fixing belt (a crack of the heat generation layer) is evaluated. The result is shown in Table 1.

TABLE 1

| | | Metal layer configuration | Thickness of metal layer (μM) | Property values: Half width (2 θ°) | Property values: Strain (%) | Property values: Clearance (mm) | Heating method | Evaluation result: Setting temperature (degrees C.) | Evaluation result: Heat generation characteristics (Reliability) | Evaluation result: Belt crack |
|---|---|---|---|---|---|---|---|---|---|---|
| EXAMPLES | 1 | SUS304 | 50 | 5 | +5.5 | +7.0 | Halogen lamp | 180 | OK for 200 hrs | None |
| | 2 | SUS304 | 55 | 7 | +8.0 | +8.5 | Halogen lamp | 180 | OK for 200 hrs | None |
| | 3 | SUS304 | 50 | 4.5 | +3.5 | +5.0 | Resistant heating | 180 | OK for 200 hrs | None |
| | 4 | SUS304 | 55 | 8 | +9.5 | +6.5 | Resistant heating | 180 | OK for 200 hrs | None |
| | 5 | Ni | 55 | 3 | −1.5 | −0.5 | Halogen lamp | 180 | OK for 200 hrs | None |
| | 6 | Ni | 60 | 2.5 | −2.5 | −2.0 | Halogen lamp | 180 | OK for 200 hrs | None |
| | 7 | Ti | 45 | 6 | +6.0 | +7.5 | Resistant heating | 180 | OK for 200 hrs | None |
| | 8 | Ti | 50 | 4.5 | +4.0 | +3.5 | Resistant heating | 180 | OK for 200 hrs | None |
| | 9 | Cu/SUS304 | 10/45 | 5.5 | +2.5 | +3.5 | IH heating | 180 | OK for 200 hrs | None |
| | 10 | Cu/SUS304 | 15/45 | 5 | +1.5 | +2.0 | IH heating | 180 | OK for 200 hrs | None |
| | 11 | Cu/SUS305 | 10/45 | 4.5 | +1.5 | +2.5 | IH heating | 180 | OK for 200 hrs | None |
| | 12 | Cu/SUS305 | 15/45 | 3.5 | +0.5 | +2.0 | IH heating | 180 | OK for 200 hrs | None |
| COMPARATIVE EXAMPLES | 1 | SUS304 | 50 | 18 | +38.0 | +39.0 | Halogen lamp | 180 | Heat generation trouble at 40 hrs | Occur |
| | 2 | SUS304 | 55 | 15 | +33.0 | +34.5 | Halogen lamp | 180 | Heat generation trouble at 40 hrs | Occur |
| | 3 | SUS304 | 50 | 16.5 | +35.5 | +37.0 | Resistant heating | 180 | Heat generation trouble at 40 hrs | Occur |
| | 4 | SUS304 | 55 | 14.5 | +32.5 | +32.0 | Resistant heating | 180 | Heat generation trouble at 37 hrs | Occur |
| | 5 | Ni | 55 | 14 | +37.5 | +38.0 | Halogen lamp | 180 | Heat generation trouble at 35 hrs | Occur |
| | 6 | Ti | 50 | 17.5 | +39.0 | +41.0 | Resistant heating | 180 | Heat generation trouble at 33 hrs | Occur |
| | 7 | Cu/SUS304 | 10/45 | 19.5 | +42.5 | +43.5 | IH heating | 180 | Heat generation trouble at 30 hrs | Occur |
| | 8 | Cu/SUS304 | 15/45 | 18 | +40.5 | +42.0 | IH heating | 180 | Heat generation trouble at 40 hrs | Occur |
| | 9 | Electro-formed Ni | 50 | 25.5 | +45.5 | +47.5 | Resistant heating | 180 | Heat generation trouble at 25 hrs | Occur |
| | 10 | Electro-formed Ni | 60 | 27 | +48.0 | +51.0 | Resistant heating | 180 | Heat generation trouble at 21 hrs | Occur |

From the result shown in Table 1, in the fixing device 60 employing, as the fixing belt, an endless belt having a metal layer whose half width of the diffraction peak in the X-ray diffraction is 10 degrees or lower (the examples 1 to 12), it is found that a belt crack does not occur in the fixing belt for 200 hours or more.

In contrast, in the fixing device 60 employing, as the fixing belt, an endless belt having a metal layer whose half width of the diffraction peak in the X-ray diffraction is more than 10 degrees (the comparative examples 1 to 10), it is found that heat generation trouble occurs in the fixing belt at approximately 40 hours and that a belt crack occurs.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An endless belt comprising:

a metal layer that includes at least one layer, that is cylindrically formed, and that has a surface strain within a range of about −10% to about +30% in a state where the metal layer is cut open in an axial direction; and a release layer that is stacked on the metal layer.

2. The endless belt according to claim 1, wherein the metal layer has a surface strain within a range of about −5% to about +10% in a state where the metal layer cylindrically formed is cut open in an axial direction.

3. The endless belt according to claim 1, wherein, in a state where the metal layer cylindrically formed is cut open in an axial direction, a distance between end faces of the metal layer that has been cut open is within a range of about −10 mm to about +30 mm.

4. The endless belt according to claim 1, wherein, in a state where the metal layer cylindrically formed is cut open in an axial direction, a distance between end faces of the metal layer that has been cut open is within a range of about −5 mm to about +10 mm.

5. The endless belt according to claim 1, wherein metallic crystals in the metal layer are aligned in a surface direction of the metal layer.

6. The endless belt according to claim 1, wherein the metal layer includes one material selected from stainless alloy, nickel and nickel alloy.

7. The endless belt according to claim 1, wherein a film thickness of the metal layer is within a range of about 5 μm to about 100 μm.

8. A fixing device comprising:

a fixing belt having a metal layer that includes at least one layer, and that has a surface strain within a range of about −10% to about +30% in a state where the metal layer is cut open in an axial direction;

a pressure roll that forms a pressing portion between the pressure roll and the fixing belt, and that is driven to be rotated; and a heating member that heats the fixing belt.

9. The fixing device according to claim 8, wherein the metal layer of the fixing belt is cylindrically formed.

10. The fixing device according to claim 8, wherein, in a state where the metal layer of the fixing belt, which is cylindrically formed, is cut open in an axial direction, a distance between end faces of the metal layer that has been cut open is within a range of about −10 mm to about +30 mm.

11. The fixing device according to claim 8, wherein metallic crystals in the metal layer of the fixing belt are aligned in a surface direction of the metal layer of the fixing belt.

12. The fixing device according to claim 8, wherein the metal layer of the fixing belt includes one material selected from stainless alloy, nickel and nickel alloy.

13. The fixing device according to claim 8, wherein the heating member is an electromagnetic induction heating member that is disposed so as to face the fixing belt, and that causes the fixing belt to generate heat by use of a magnetic field generated by an alternate current.

14. An image forming apparatus comprising:

an image formation unit that forms a toner image;

a transfer unit that transfers the toner image to a recording medium; and a fixing unit that fixes the toner image transferred to the recording medium, onto the recording medium;

the fixing unit including:

a fixing belt having a metal layer that includes at least one layer, that is caused to generate heat by a magnetic field, and that has a surface strain within a range of about −10% to about +30% in a state where the metal layer is cut open in an axial direction;

a pressure roll that forms a pressing portion between the pressure roll and the fixing belt, and that is driven to be rotated; and an electromagnetic induction heating member that is disposed so as to face the fixing belt, and that causes the fixing belt to generate heat by use of a magnetic field generated by an alternate current.

15. The image forming apparatus according to claim 14, wherein the metal layer of the fixing belt is cylindrically formed.

16. The image forming apparatus according to claim 14, wherein, in a state where the metal layer of the fixing belt, which is cylindrically formed, is cut open in an axial direction, a distance between end faces of the metal layer that has been cut open is within a range of about −10 mm to about +30 mm.

17. The image forming apparatus according to claim 14, wherein metallic crystals in the metal layer of the fixing belt are aligned in a surface direction of the metal layer of the fixing belt.

18. The image forming apparatus according to claim 14, wherein the metal layer of the fixing belt includes one material selected from stainless alloy, nickel and nickel alloy.

* * * * *